US007394424B1

(12) United States Patent
Jelinek et al.

(10) Patent No.: US 7,394,424 B1
(45) Date of Patent: Jul. 1, 2008

(54) METHODS AND APPARATUS FOR IMPLEMENTING A WIDEBAND DIGITAL BEAMFORMING NETWORK

(75) Inventors: Carl O. Jelinek, Camarillo, CA (US); Keith C. Smith, Santa Barbara, CA (US); Fred Gallagher, Santa Barbara, CA (US); Steven L. Kaufman, Port Hueneme, CA (US); David J. Fairfield, Goleta, CA (US)

(73) Assignee: Raytheon Company, Waltham, MA (US)

( * ) Notice: Subject to any disclaimer, the term of this patent is extended or adjusted under 35 U.S.C. 154(b) by 371 days.

(21) Appl. No.: 11/267,802

(22) Filed: Nov. 4, 2005

(51) Int. Cl.
*H01Q 3/22* (2006.01)
*H01Q 3/26* (2006.01)

(52) U.S. Cl. ..... 342/375

(58) Field of Classification Search ..... 342/375
See application file for complete search history.

(56) References Cited

U.S. PATENT DOCUMENTS 5,084,708 A * 1/1992 Champeau et al. ..... 342/377
5,130,717 A * 7/1992 Ewen et al. ..... 342/375
5,414,433 A * 5/1995 Chang ..... 342/375
7,123,882 B1 * 10/2006 Frazier ..... 455/73

* cited by examiner

*Primary Examiner*—Gregory C Issing
(74) *Attorney, Agent, or Firm*—Leonard A. Alkov

(57) ABSTRACT

The present invention concerns methods and apparatus for implementing a true-time-delay wideband digital beamformer. In true-time-delay wideband digital beamformers of the present invention, improved control over beam properties formed by the combination of the beamformer and a multi-element antenna coupled to the beamformer is achieved through finer control of delays imparted to data signals. In beamformers of the present invention, data is delayed using a coarse control that provides a delay in whole increments of a clock cycle of a digital clock reference and a fine control that provides a delay corresponding to a fraction of a whole clock cycle of the digital clock reference. In the true time delay method of the present invention, transmission and reception across a wide frequency band is accommodated. In the true time delay method of the present invention, multiple simultaneous beams are formed independently, beam-to-beam, across a wide frequency band.

43 Claims, 8 Drawing Sheets

METHODS AND APPARATUS FOR IMPLEMENTING A WIDEBAND DIGITAL BEAMFORMING NETWORK

TECHNICAL FIELD

The present invention generally concerns digital beamforming systems for use in communications systems and more particularly concerns digital true-time-delay wideband beamforming systems having multiple simultaneous beamforming capability.

BACKGROUND

Beamforming is a multi-channel array processing method that generates a focused antenna beam electronically, i.e., without the need for physical interaction between a physical aspect of an antenna (such as, for example, a parabolic dish) and an electromagnetic wave. Instead, in antennas comprised of either a linear or a planar two-dimensional array of antenna elements, signals that have been subjected to differing time delays are applied to the antenna elements, thereby focusing the beam formed by the antenna through an electronic process as opposed to a physical process. In essence, a beamformer acts as a spatial band pass filter, amplifying the antenna signal in some directions and attenuating the signal in other directions.

Beamforming, which is inherently a time shift effect, is generally accomplished either through time shift methods or phase shift methods. In time delay beamforming true time delays are applied to signals before they are coupled to antenna elements. In a true time delay beamformer a frequency-independent time delay is added to each channel based on the desired direction of the beam. The phase shift method of beamforming is frequency dependent and approximates the time shift method only over a limited bandwidth.

In contrast to true-time delay beamforming where true time delays are applied to signals, in phase-shift beamforming desired time delays first are converted to phase shifts and then applied to the signals.

In most, if not all, applications, those skilled in the art desire more precise means for controlling beam properties. Signal-to-noise ratios and efficiency of power utilization generally improve with more precise control over beam properties. Those skilled in the art also desire beamforming methods and apparatus that are subject to increased levels of computer control. In analog beamforming equipment components providing time delays require careful matching and tuning for proper operation.

In certain applications, it is desirable to transmit and to receive signals across a relatively wide frequency band. In applications where this is desirable, beamformers using phase shifters are impractical because phase shifters are inherently narrow band devices and are thus incapable of accommodating signals across a wide frequency band.

In other applications, it is desirable to transmit and to receive multiple beams simultaneously. In such applications the limitations of analog-based beamformers associated with size, numbers of interconnections, and complexity of control become even more problematic.

Thus, those skilled in the art desire beamforming methods and apparatus that provide more precise control over beam properties, and are subject to increased levels of computer control.

Those skilled in the art also desire beamforming methods operable over a relatively wide frequency band.

In addition, those skilled in the art desire the ability to form multiple beams simultaneously using the same antenna array.

Further, those skilled in the art desire beamforming methods and apparatus having the ability to form multiple beams simultaneously while maintaining the ability to operate over a relatively wideband frequency range.

Finally, those skilled in the art desire beamforming methods and apparatus that result in relatively small physical implementations.

SUMMARY OF THE PREFERRED EMBODIMENTS

The foregoing and other problems are overcome, and other advantages are realized, in accordance with the following embodiments of the present invention.

A first embodiment of the present invention comprises a time delay circuit for imparting a time delay to a data signal associated with an antenna element in a multi-element antenna, the time delay circuit comprising: a data signal input for accepting the data signal to be delayed by the time delay circuit; a digital clock reference; a memory storing beamforming control information, wherein the beamforming control information determines physical characteristics of a beam to be formed by the multi-element antenna; a delay control coupled to the memory, where the delay control calculates the time delay to be applied to the data signal in dependence on the beamforming control information, wherein the time delay calculated by the delay control comprises a coarse delay control component expressed in terms of a number of whole clock cycles of the digital clock reference and a fine delay control component expressed in terms of a portion of a whole clock cycle of the digital clock reference, the delay control further comprising a coarse delay control signal output for conveying a coarse delay control signal corresponding to the coarse delay control component and a fine delay control signal output for conveying a fine delay control signal corresponding to the fine delay control component; a tap delay line coupled to the data signal input and the coarse delay control signal output of the delay control, the tap delay line for imparting a coarse delay to the data signal by delaying the data signal in dependence on the coarse delay control signal, the tap delay line having an output for conveying the data signal after the data signal has been delayed by the coarse delay; a programmable digital delay line coupled to the fine delay control signal output of the delay control and to the digital clock reference, the programmable digital delay line generating a digital-to-analog converter clock delay signal in dependence on the fine delay control signal, the programmable digital delay line having an output; and a digital-to-analog converter coupled to the output of the tap delay line and the output of the programmable digital delay line for performing a digital-to-analog conversion on the data signal, wherein during the digital-to-analog conversion the data signal is further delayed by a fine delay corresponding to a portion of a whole clock cycle in dependence on the digital-to-analog clock converter delay signal, the digital-to-analog converter having an output for conveying the data signal to which has been imparted the coarse delay and the fine delay.

A second embodiment of the present invention comprises a time delay circuit for imparting a time delay to a signal associated with an antenna element in a multi-element antenna, the time-delay circuit comprising: a signal input for accepting the signal to be delayed by the time delay circuit; digital clock reference means for providing a digital clock reference signal; memory means for storing beamforming control information, wherein the beamforming control information determines physical characteristics of a beam formed by the multi-element antenna; delay control means coupled to the memory means for calculating the time delay to be applied to the signal in dependence on the beamforming control information, wherein the time delay calculated by the delay control means comprises a coarse delay control component expressed in terms of a number of whole clock cycles of the digital clock reference means and a fine delay control component expressed in terms of a portion of a whole clock cycle of the digital clock reference means, the delay control means further comprising: coarse delay signal output means for conveying a coarse delay control signal corresponding to the coarse delay control component; and fine delay signal output means for conveying a fine delay control signal corresponding to the fine delay control component; and delay application means coupled to the signal input for applying the time delay calculated by the delay control means to the signal, the delay application means further comprising: coarse delay means coupled to the coarse delay signal output means of the delay control means for imparting a coarse delay to the signal in dependence on the coarse delay control signal; and fine delay means coupled to the fine delay signal output means of the delay control means for imparting a fine delay to the signal in dependence on the fine delay control signal.

A third embodiment of the present invention comprises a beamforming network for imparting time delays to a plurality of signals, where each signal is associated with a particular antenna element of a multi-element antenna, wherein the beamforming network further comprises: a digital clock reference; a memory storing beamforming control information, wherein the beamforming control information determines physical characteristics of a beam formed by the combination of the beamforming network and the multi-element antenna; a delay control coupled to the memory, where the delay control calculates the time delay to be applied to each of the plurality of signals in dependence on the beamforming control information, wherein the time delay calculated for each of the signals comprises a coarse delay control component expressed in terms of a number of whole clock cycles of the digital clock reference and a fine delay control component expressed in terms of a portion of a whole clock cycle of the digital clock reference, the delay control having a coarse delay control signal output for conveying coarse delay control signals corresponding to the coarse delay control components calculated for each of the signals and a fine delay control signal output for conveying fine delay control signals corresponding to the fine delay control components calculated for each of the signals; a plurality of time delay circuits, wherein each of the time delay circuits is associated with a particular signal and is coupled to a particular antenna element associated with the particular signal, each of the plurality of time delay circuits comprising: an input port for receiving a particular signal; and delay application means coupled to the input port for imparting the time delay calculated for the particular signal by the delay control, the delay application means further comprising: coarse delay means coupled to the coarse delay control signal output of the delay control, the coarse delay means imparting a coarse delay to the particular signal in dependence on the coarse delay control signal generated by the delay control for the particular signal, and fine delay means coupled to the fine delay control signal output of the delay control, the fine delay means imparting a fine delay to the particular signal in dependence on the fine delay control signal generated by the delay control for the particular signal.

A fourth embodiment of the present invention comprises a beamforming system capable of generating a plurality of separate beams in combination with a multi-element antenna, the beamforming system comprising: a plurality of beamforming networks, where each of the beamforming networks is associated with a particular beam of the plurality of separate beams to be formed by the beamforming system and the multi-element antenna, and where each of the beamforming networks is operable to impart time delays to a plurality of signals, where each signal is associated with a particular antenna element of the multi-element antenna, and where each of the beamforming networks further comprises: a digital clock reference; a memory storing beamforming control information, wherein the beamforming control information determines physical characteristics of a particular beam of the plurality of separate beams to be formed by the beamforming network and the multi-element antenna; a delay control coupled to the memory, where the delay control calculates the time delay to be applied to each of the plurality of signals in dependence on the beamforming control information, wherein the time delay calculated for each of the signals comprises a coarse delay component expressed in terms of a number of whole clock cycles of the digital clock reference and a fine delay control component expressed in terms of a portion of a whole clock cycle of the digital clock reference, the delay control having a coarse delay control signal output for conveying coarse delay control signals corresponding to the coarse delay control components calculated for each of the signals and a fine delay control signal output for conveying fine delay control signals corresponding to the fine delay control components calculated for each of the signals; a plurality of time delay circuits, wherein each of the time delay circuits is associated with a particular signal and is coupled to a particular antenna element associated with the particular signal, each of the plurality of time delay circuits comprising: an input port for receiving a particular signal; and delay application means coupled to the input port for imparting the time delay calculated for the particular signal by the delay control, the delay application means further comprising: coarse delay means coupled to the coarse delay control signal output of the delay control, the coarse delay means imparting a coarse delay to the particular signal in dependence on the coarse delay control signal generated by the delay control for the particular signal; and fine delay means coupled to the fine delay control signal output of the delay control, the fine delay means imparting a fine delay to the particular signal in dependence on the fine delay control signal generated by the delay control for the particular signal.

A fifth embodiment of the present invention comprises a memory medium storing a computer program executable by a digital processor incorporated in a beamforming circuit, whereby when the digital processor executes the computer program the following operations are performed: receiving a command to calculate a time delay to be applied to a signal associated with a particular antenna element coupled to the beamforming circuit, wherein the particular antenna element is part of a multi-element antenna; accessing beamforming control information, wherein the beamforming control information determines physical characteristics of a beam to be formed by the multi-element antenna; calculating a coarse delay in dependence on the beamforming control information, wherein the coarse delay corresponds to a number of whole clock cycles of a digital clock reference the signal is to be delayed; generating a coarse delay control signal reflecting the coarse delay calculated for the signal; providing the coarse delay control signal to coarse delay means operable to delay the signal by the coarse delay indicated in the coarse delay control signal; delaying the signal associated with the particular antenna element by the coarse delay indicated in the coarse delay control signal; calculating a fine delay in dependence on the beamforming control information, wherein the fine delay corresponds to a portion of a whole clock cycle of the digital clock reference; generating a fine delay control signal reflecting the fine delay calculated for the signal; providing the fine delay control signal to fine delay means operable to delay the signal by the fine delay indicated in the fine delay control signal; delaying the signal associated with the particular antenna element by the fine delay indicated in the fine delay control signal; and whereby the combination of the delay operations performed by the coarse delay means and the fine delay means in dependence on the coarse delay control signal and the fine delay control signal delay the signal associated with the particular antenna element by the sum of the number of whole clock cycles of the digital clock reference indicated in the coarse delay control signal and the portion of a whole clock cycle of the digital clock reference indicated in the fine delay control signal A sixth embodiment of the present invention comprises a memory medium storing a computer program executable by at least one digital processor incorporated in a beamforming network, whereby when the at least one digital processor executes the computer program the following operations are performed: for each signal associated with a particular antenna element of a multi-element antenna coupled to the beamforming network, receiving a command to calculate a time delay to be applied to the signal associated with the particular antenna element; accessing beamforming control information, wherein the beamforming control information determines physical characteristics of a beam to be formed by the multi-element antenna; calculating a coarse delay in dependence on the beamforming control information, wherein the coarse delay corresponds to a number of whole clock cycles of a digital clock reference the signal is to be delayed; generating a coarse delay control signal reflecting the coarse delay calculated for the signal; providing the coarse delay control signal to coarse delay means operable to delay the signal by the coarse delay indicated in the coarse delay control signal; delaying the signal associated with the particular antenna element by the coarse delay indicated in the coarse delay control signal; calculating a fine delay in dependence on the beamforming control information, wherein the fine delay corresponds to a portion of a whole clock cycle of the digital clock reference; generating a fine delay control signal reflecting the fine delay calculated for the signal; providing the fine delay control signal to fine delay means operable to delay the signal by the fine delay indicated in the fine delay control signal; delaying the signal associated with the particular antenna element by the fine delay indicated in the fine delay control signal; and whereby the combination of the delay operations performed by the coarse delay means and the fine delay means in dependence on the coarse delay control signal and the fine delay control signal delay the signal associated with the particular antenna element by the sum of the number of whole clock cycles of the digital clock reference indicated in the coarse delay control signal and the portion of a whole clock cycle of the digital clock reference indicated in the fine delay control signal.

Thus it is seen that the foregoing embodiments of the present invention overcome the limitations of the prior art. In particular, beamformers operating in accordance with the prior art are subject to a number of limitations. For example, beamformers using phase shift methods require both careful component matching and tuning to operate properly. In addition, beamformers using phase shift methods are limited to a relatively narrow frequency band of operation. Further, the often bulky nature of phase-shift beamformers limits their applicability in situations where multiple beam operation is required.

In contrast, the methods and apparatus of the present invention provide beamformer systems that are operable over wide frequency bands. In addition, true-time-delay beamforming systems constructed in accordance with the present invention are easier to operate since the systems are subject to computer control. Further, true-time-delay systems constructed in accordance with the present invention can be implemented in compact integrated circuits and pc boards, meaning that a relatively compact beamforming system having multi-beam capability can be implemented.

In conclusion, the foregoing summary of the embodiments of the present invention is exemplary and non-limiting. For example, one skilled in the art will understand that one or more aspects or steps from one embodiment can be combined with one or more aspects or steps from another embodiment of the present invention to create a new embodiment within the scope of the present invention.

BRIEF DESCRIPTION OF THE DRAWINGS

The foregoing and other aspects of these teachings are made more evident in the following Detailed Description of the Preferred Embodiments, when read in conjunction with the attached Drawing Figures, wherein.

DETAILED DESCRIPTION OF THE PREFERRED EMBODIMENTS

Figure 1:
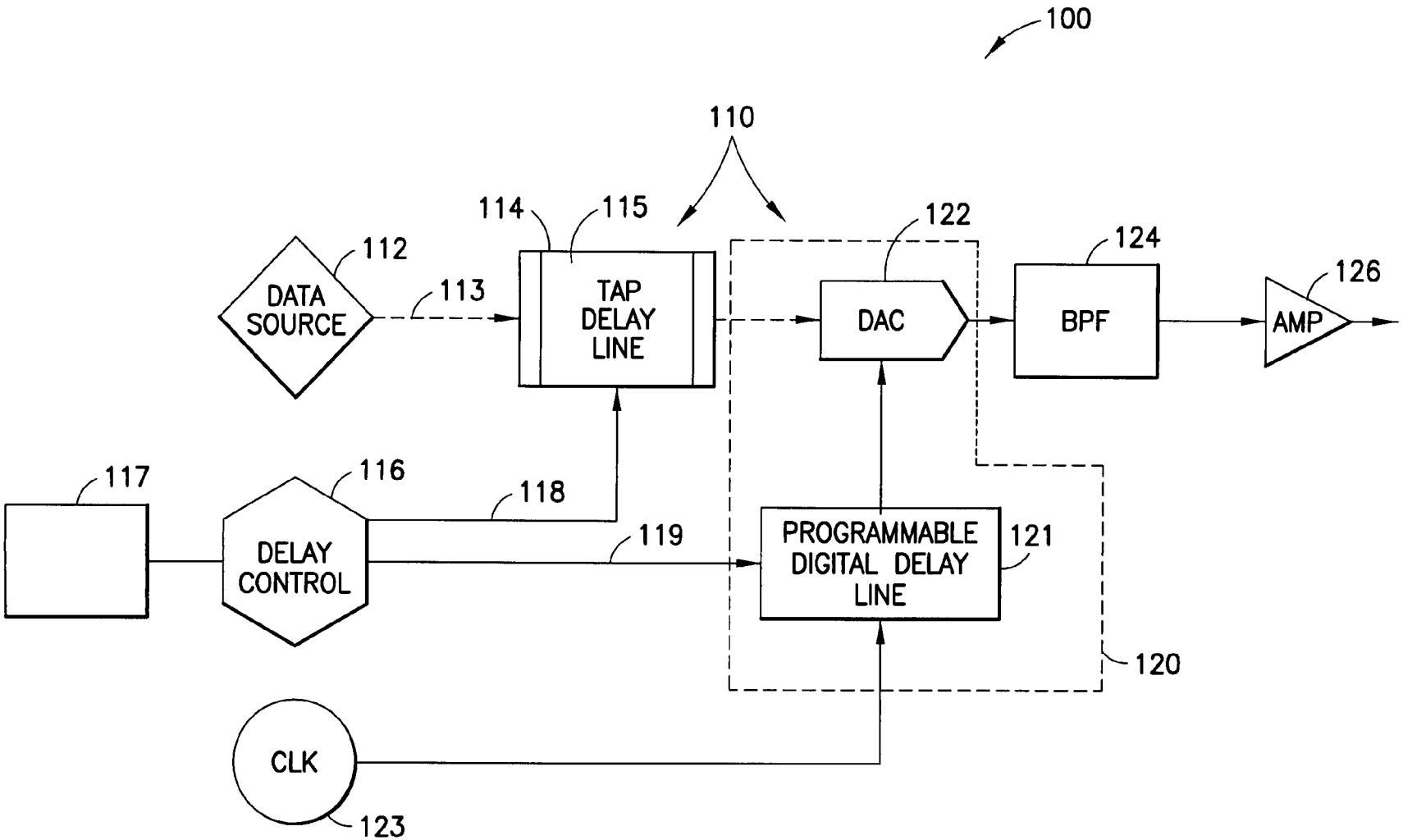
FIG. 1 depicts a time delay circuit for use in a beamforming network associated with a multi-element antenna operating in a transmission mode, the time delay circuit made in accordance with the present invention.

An embodiment of the present invention comprises a time delay circuit 100 depicted in FIG. 1. The time delay circuit depicted in FIG. 1 comprises a building block intended for use in a true time delay digital beamforming network associated with a multi-element antenna. The time delay circuit 100 depicted in FIG. 1 receives a data signal from an external source. The data signal may correspond to any number of practical applications for the invention, such as in radar, telecommunications, electronic warfare (jamming), etc. In transmitting situations, the data signal is applied to the time delay circuit. First, a coarse delay is imparted to the data signal. The coarse delay corresponds to a number of whole clock cycles of a digital clock reference. Then, within the context of a digital-to-analog conversion, a fine delay is imparted to the data signal. The fine delay corresponds to a fractional portion of a whole clock cycle of the digital clock reference. The data signal, having been delayed by a coarse delay and then by a fine delay, is filtered, amplified and then coupled to an input port of an antenna element of the multi-element antenna. The amount of delay is calculated based on beamforming control information calculated for, and provided to, the beamforming network. The beamforming control information comprises information defining the physical characteristics of a beam necessary to perform a particular application, and generally concerns the shape and direction of the beam. In situations where the beamforming network is coupled to a planar antenna comprised of a two-dimensional array of antenna elements, the beamforming control information generally concerns azimuth and elevation information used for pointing and/or steering the beam formed by the antenna and beamforming network.

One skilled in the art will understand that the methods and apparatus of the present invention are equally applicable in transmitting and receiving situations. For example, in a dual-mode antenna and beamforming system used in electronic warfare to perform jamming operations, the precise delay control provided by the combination of the coarse and fine delay can be applied both in receiving situations where the antenna is used to identify signals to be jammed and in transmitting situations where jamming signals are emitted by the antenna.

In receiving situations, an analog-to-digital converter may be used instead of the digital-to-analog converter.

A particular embodiment of a time delay circuit 100 capable of operating in accordance with the present invention is depicted in FIG. 1 and will now be described in greater detail, but one of ordinary skill in the art will understand that other time delay circuits are capable of operating in accordance with the present invention. The time delay circuit 100 depicted in FIG. 1 comprises a delay application means 110 comprised of a coarse delay means 114 and a fine delay means 120. A data source 112 is coupled to an input 113 of the coarse delay means 114, which in this embodiment comprises a tap delay line 115. The tap delay line 115 is also coupled to the output 118 of a delay control 116. The delay control 116 is operable to calculate a time delay to be applied to the data signal. The delay control 116 is coupled to a memory 117 containing beamforming control information. The beamforming control information generally concerns the shape and direction of the beam to be formed by the beamforming network (of which the time delay circuit is part) and a multi-element antenna. In situations where the time delay circuit 100 is a part of a beamforming network coupled to a planar antenna comprised of a two-dimensional array of antenna elements, the beamforming control information would typically comprise azimuth and elevation information necessary to point the beam. In the present invention, the time delay calculated by the delay control 116 comprises a coarse delay control component expressed in terms of a number of whole clock cycles of a digital clock reference 123 and a fine delay control component expressed in terms of a fractional portion of a whole clock cycle of the digital clock reference 123. The delay control 116 further comprises a coarse delay control signal output 118 for conveying a coarse delay control signal corresponding to the coarse delay control component and a fine delay control signal output 119 for conveying a fine delay control signal corresponding to the fine delay control component.

The delay application means 110 of the time delay circuit 100 further comprises a fine delay means 120 for imparting a fine delay to the data signal after it has been delayed by the coarse delay. In the embodiment depicted in FIG. 1, the fine delay means comprises a programmable digital delay line 121 and a digital-to-analog converter 122. In this particular embodiment, the fine delay is imparted to the data signal within the context of digital-to-analog conversion. One of ordinary skill in the art will readily understand that other hardware arrangements are possible to perform the fine delay, which may or may not occur within the context of a digital-to-analog conversion. The programmable digital delay line 121 is coupled to the fine delay control signal output 119 of the delay control 116 and to the digital clock reference 123. The programmable digital delay line 121 generates a digital-to-analog converter clock delay signal for delaying the clock of the digital-to-analog converter 122 in dependence on the fine delay control signal of the delay control 116. In the embodiment depicted in FIG. 1, during the digital-to-analog conversion process performed by the digital-to-analog converter 122, a fine delay is also imparted to the data signal.

After the data signal has been delayed by the coarse delay and the fine delay, and in the embodiment depicted in FIG. 1, converted from digital to analog format, the data signal is then filtered by a filter 124. In the embodiment depicted in FIG. 1 the filter is a band pass filter. Then, after the data signal has been filtered, it is amplified by amplifier 126.

In variants of the embodiment depicted in FIG. 1, variable beamwidth control is implemented by adjusting the gain of drive amplifier 126. For example, in a beamforming network comprised of a plurality of beamforming circuits 100 like that depicted in FIG. 1, beamwidth control can be achieved by selectively nulling data signals associated with beamforming circuits 100 coupled to antenna elements on edges of an antenna through the gain of amplifiers 126.

Now a beamforming network 200 operating in accordance with the present invention for use in a transmitting mode will be described. A beamforming network operating in accordance with the present invention is generally operable to impart delays to a plurality of data signals to be applied to a plurality of antenna elements comprising a multi-element antenna. The various delays applied to the data signals to be coupled to the antenna elements determine the physical characteristics of the beam formed by the beamforming network and the multi-element antenna. In particular by, for example, varying the delays across antenna elements comprising a planar antenna the beam formed by the antenna can be pointed in various directions. Additionally, the beam shape can be varied by applying non-linear progressive time delays to data signals applied to antenna elements distributed across the face of an antenna.

Figure 2:
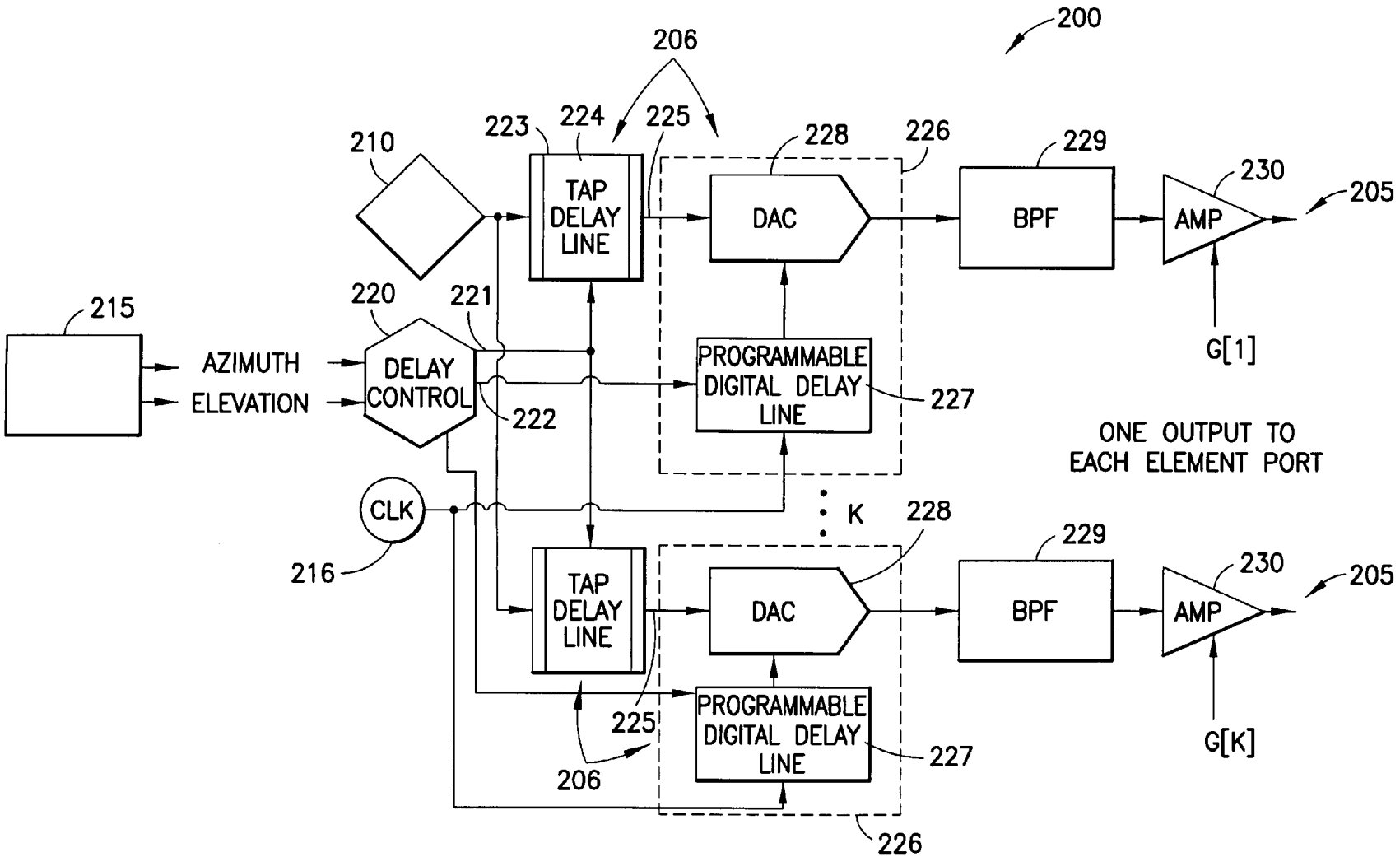
FIG. 2 depicts a beamforming network for use in combination with a multi-element antenna operating in a transmission mode, the beamforming network made in accordance with the present invention.

The beamforming network 200 depicted in FIG. 2 is operable in combination with a multi-element antenna having K antenna elements. Accordingly, there are K time delay circuits 205 to impart time delays to the K data signals necessary for the K antenna elements. The beamforming network 200 comprises a data input 210 for providing the K data signals to which delays will be imparted. The beamforming network 200 further comprises a delay control 220. The delay control 220 calculates the time delay to be applied to each of the plurality of K data signals in dependence on beamforming information provided by a memory 215. The delays are imparted to the K data signals by delay application means 206. Delay application means 206 comprises coarse delay means 223 and fine delay means 226 and operates to impart the time delays calculated for each of the K signals by the delay control means 220. As described previously, beamforming control information generally comprises information that describes the physical characteristics of a beam (such as, for example shape, direction, etc.) necessary to perform the task for which the beam is used. The beamforming network 200 depicted in FIG. 2 is coupled to a two-dimensional planar antenna, and thus the beamforming control information comprises azimuth and elevation information. The time delay calculated for each signal of K data signals comprises a coarse delay control component expressed in terms of a number of whole clock cycles of a digital clock reference 216 and a fine delay control component expressed in terms of a portion of a whole clock cycle of the digital clock reference 216. The delay control 220 further comprises coarse delay signal outputs 221 for conveying coarse delay control signals corresponding to the coarse delay control components calculated for each of the K data signals and fine delay control signal outputs 222 for conveying fine delay control signals corresponding to the fine delay control components calculated for each of the K data signals.

As stated previously, there are K time delay circuits 205 operable to impart time delays to K data signals in the beamforming network 200 depicted in FIG. 2. Each time delay circuit 205 comprises coarse delay means 223 for imparting a coarse time delay to particular ones of K data signals. In the embodiment depicted in FIG. 2, the coarse delay means 223 comprises a tap delay line 224. The tap delay line 224 of each time delay circuit 205 is coupled to an input port for receiving a particular one of K data signals, and is also coupled to the coarse delay control signal output 221 of the delay control 220 for receiving a coarse delay control signal indicating the delay to be applied to the data signals.

After a coarse delay has been imparted to the data signals by the tap delay lines 224, the delayed data signals are then coupled to inputs 225 of a fine delay means. In the embodiment depicted in FIG. 2, the fine delay means 226 comprises the combination of digital-to-analog converters 228 and programmable digital delay lines 227. The digital-to-analog converters 228 along with programmable digital delay lines 227 impart a fine delay to particular ones of the K data signals. Similarly to the embodiment depicted in FIG. 1, the fine delay in the beamforming network depicted in FIG. 2 is imparted to the data signals within the context of digital-to-analog conversion. One of ordinary skill in the art will understand that other arrangements are possible within the context of the present invention where a fine delay may be imparted during a digital-to-analog conversion process, or separately from a digital-to-analog conversion process.

In the embodiment depicted in FIG. 2, the programmable digital delay lines 227 are coupled to the fine delay control signal outputs 222 of the delay control 220 and to the digital clock reference 216. The programmable digital delay lines 227 generate a digital-to-analog converter clock delay signal in dependence on the fine delay control signal generated by the delay control 220. During the digital-to-analog conversion process performed by the digital-to-analog converters 228 on particular ones of the K data signals, the data signals are delayed by a fractional portion of a whole clock cycle by the digital-to-analog converters 228 in dependence on the digital-to-analog converter clock delay signal.

After a fine delay has been imparted to the data signals, the data signals are then coupled to filters 229. In the embodiment depicted in FIG. 2, the filters 229 comprise band pass filters. After the data signals have been filtered, they are amplified by amplifiers 230 and then coupled to particular antenna elements. As described previously, additional beamwidth control can be achieved by varying gains associated with amplifiers 230.

Figure 3:
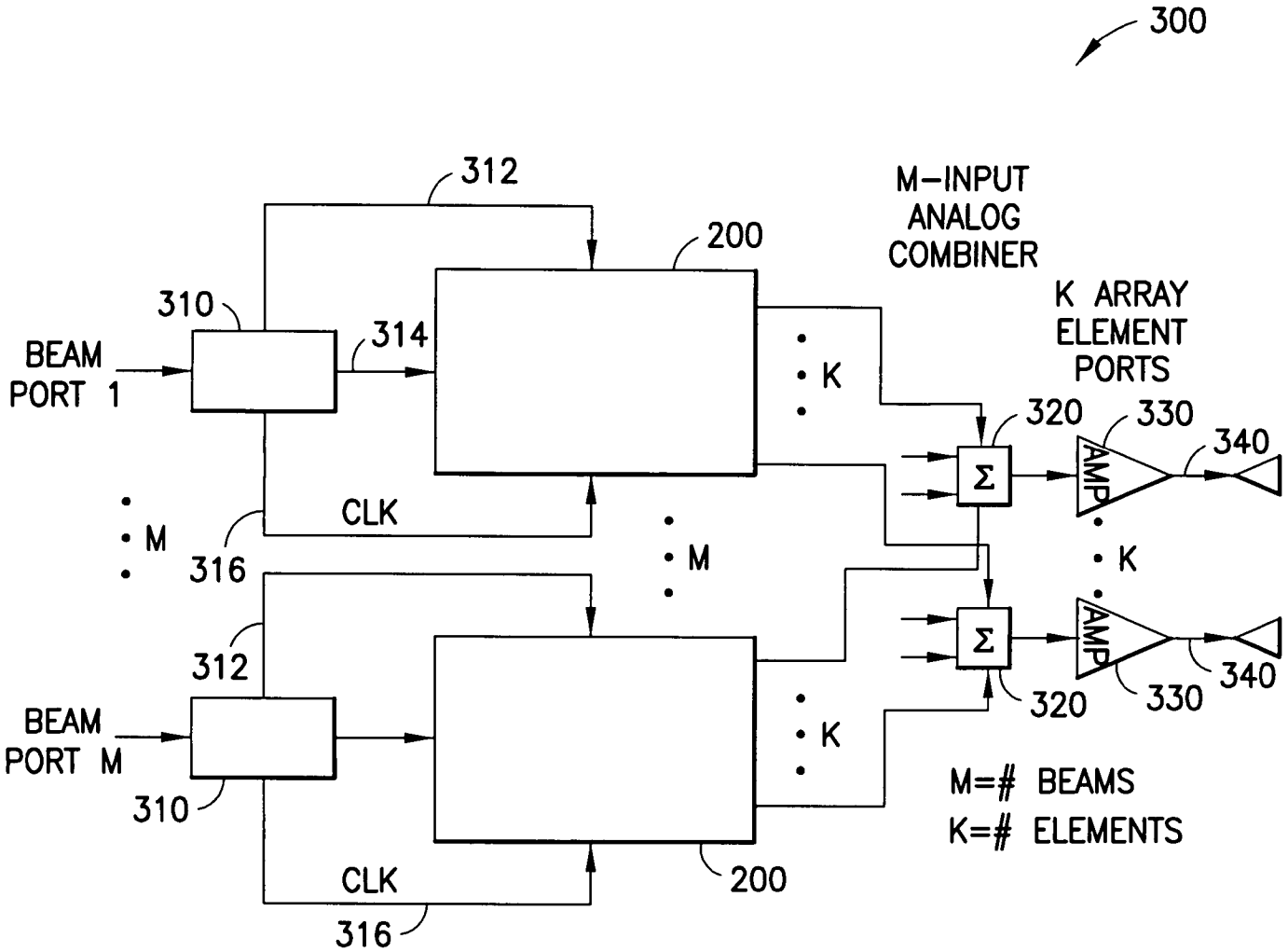
FIG. 3 depicts a beamforming system capable of generating multiple simultaneous beams in combination with a multi-element antenna operating in a transmission mode, the beamforming system made in accordance with the present invention.

A beamforming system 300 operable in conjunction with a multi-element antenna is depicted in FIG. 3. A particular advantage of the beamforming system 300 depicted in FIG. 3 is that it is capable of generating multiple simultaneous beams across a wide frequency band. The beamforming system 300 is operable to form M beams in combination with a multi-element antenna. The beamforming system 300 comprises M beamforming networks 200 like those depicted in FIG. 2. Coupled to each of M beamforming networks is a beam port 310. Beam port 310 provides data signals 312 to be delayed; beamforming control information 314; and digital clock reference information 316 associated with a particular beam to each of the M beamforming networks 200. After the delay and filtering operations, the K outputs of each of M beamforming networks 200 are collectively summed by summers 320, amplified by amplifiers 330 and then coupled to the appropriate antenna ports 340.

Another advantage of the present invention arises out of modularity of the architecture evident in FIG. 3. For example, each of the beamforming 200 networks can be implemented in a single board, and thus beamforming systems 300 for various applications can be rapidly implemented by selecting an appropriate number of boards.

As stated previously, the methods and apparatus of the present invention can also be used with an antenna operating in a receiving mode. Embodiments of time delay circuits, beamforming networks and beamforming systems for operating in a receiving mode in accordance with the present invention will now be described.

Figure 4:
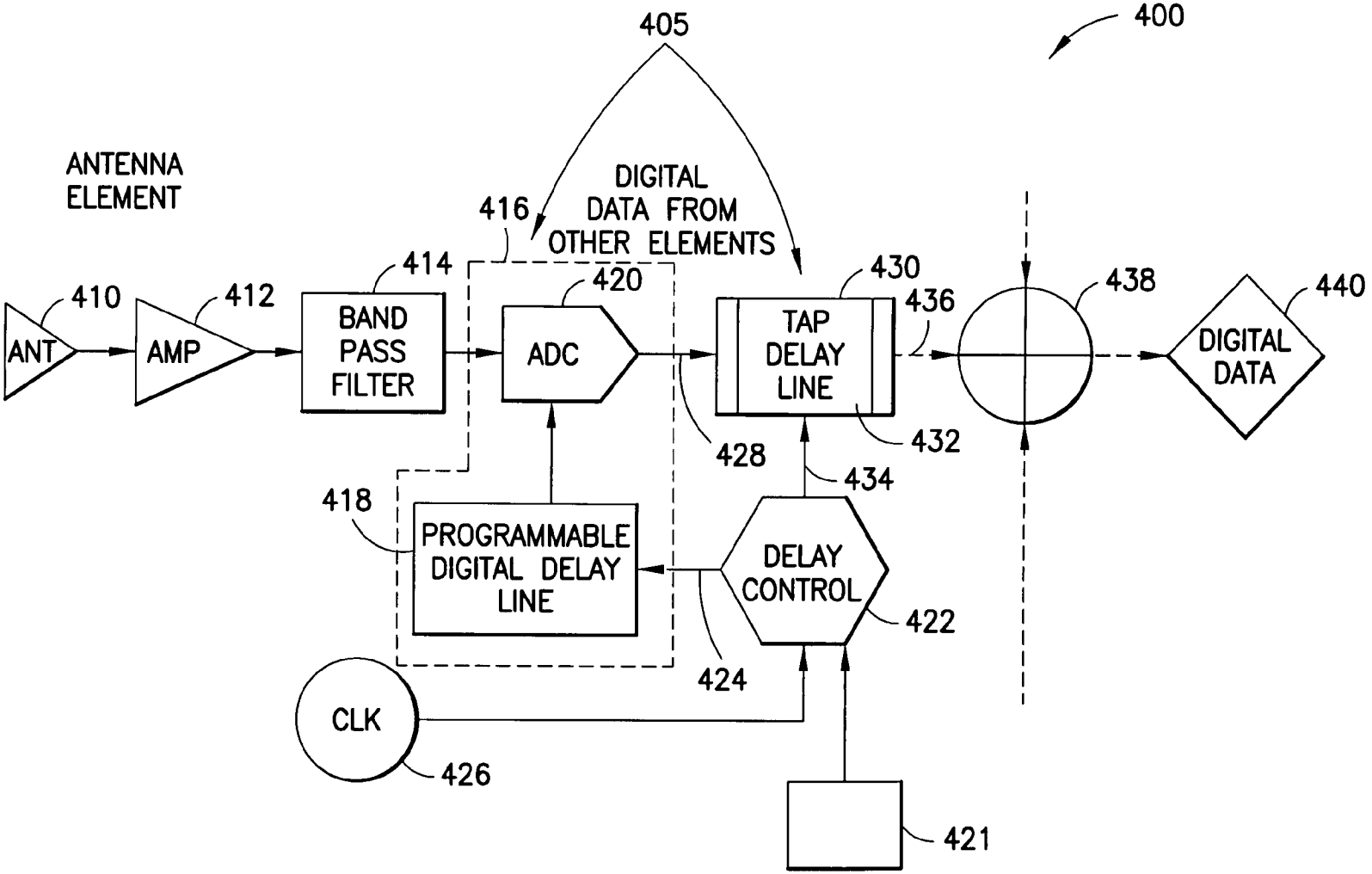
FIG. 4 is a time delay circuit for use in a beamforming network associated with a multi-element antenna operating in a reception mode, the time delay circuit made in accordance with the present invention for reception.

As in the case of the time delay circuit 100 depicted in FIG. 1, the time delay circuit 400 depicted in FIG. 4 comprises a building block intended for use in a true time delay beamforming network associated with a multi-element antenna. In contrast to the time delay circuit 100 depicted in FIG. 1, the time delay circuit 400 depicted in FIG. 4 is intended to operate in combination with an antenna operating in a receiving mode. When operating in a receiving mode, multiple time delay circuits 400 like that depicted in FIG. 4 serve to impart directionality to the multi-element antenna. In other words, time delay circuits 400 like that depicted in FIG. 4 "electronically steer" and "electronically point" the multi-element antenna with which they are associated so that energy is collected from pre-determined directions.

In the time delay circuit 400 depicted in FIG. 4, the circuit is connected to a particular antenna element 410 of a multi-element antenna (not shown). The time delay operations in the time delay circuit 400 are performed by delay application means 405 comprised of a fine delay means 416 and a coarse delay means 430. During operation, an analog signal received from the antenna element is amplified by amplifier 412, and filtered by band-pass filter 414. The output of band pass filter 414 is then coupled to the input of the fine delay means 416 for imparting a fine delay to the signal. Similar to the circuit depicted in FIG. 1, the fine delay is imparted to the signal within the context of a conversion process, but in the receive circuit case depicted in FIG. 4 the fine delay is imparted during an analog-to-digital conversion instead of a digital-to-analog conversion. The fine delay means 416 depicted in FIG. 4 comprises a programmable digital delay line 418 and an analog-to-digital converter 420. One of ordinary skill in the art will understand that other hardware implementations are possible to impart a fine delay to the signal, which may occur both within, and outside, the context of an analog-to-digital conversion. The programmable digital delay line 418 is coupled to a fine delay control signal output 424 of a delay control 422. The programmable digital delay line generates 418 an analog-to-digital converter clock delay signal for delaying the clock of the analog-to-digital converter 420 in dependence on the fine delay control signal provided by the delay control 422.

The delay control 422 is coupled to a source of beamforming control information, memory 421. The beamforming control information generally concerns the shape and direction of a beam to be formed by a multi-element antenna coupled to a beamforming network comprising a plurality of time delay circuits 400 like that depicted in FIG. 4. In the case of a multi-element antenna operating in a receiving mode, azimuth and elevation information will control the directionality of the antenna, i.e., the direction from which energy will be collected by the multi-element antenna. The delay control 422 calculates a fine delay corresponding to a fraction of a whole clock cycle of a digital clock reference 426 and a coarse delay corresponding to a number of whole clock cycles of the digital clock reference 426 using the azimuth and elevation information.

After the fine delay has been imparted to the signal by the fine delay means 416, the signal is then coupled to the input 428 of a coarse delay means 430. The coarse delay means 430 in the embodiment depicted in FIG. 4 comprises a tap delay line 432. The tap delay line 432 is coupled to a coarse delay control signal output 434 of the delay control 422. The coarse delay control signal output 434 conveys a coarse delay control signal which indicates the number of whole clock cycles of the digital clock reference 426 the signal is to be delayed. The signal at the output of the tap delay line 436 has been delayed by a fine delay corresponding to a fraction of a whole clock cycle of the digital clock reference 426 and by a coarse delay corresponding to a number of whole clock cycles of the digital clock reference 426.

A summer 438 then sums output signals from a plurality of time delay circuits similar to time delay circuit 400 depicted in FIG. 4. The digital data 440 is then available for processing in various radar, telecommunications and electronic warfare applications.

Figure 5:
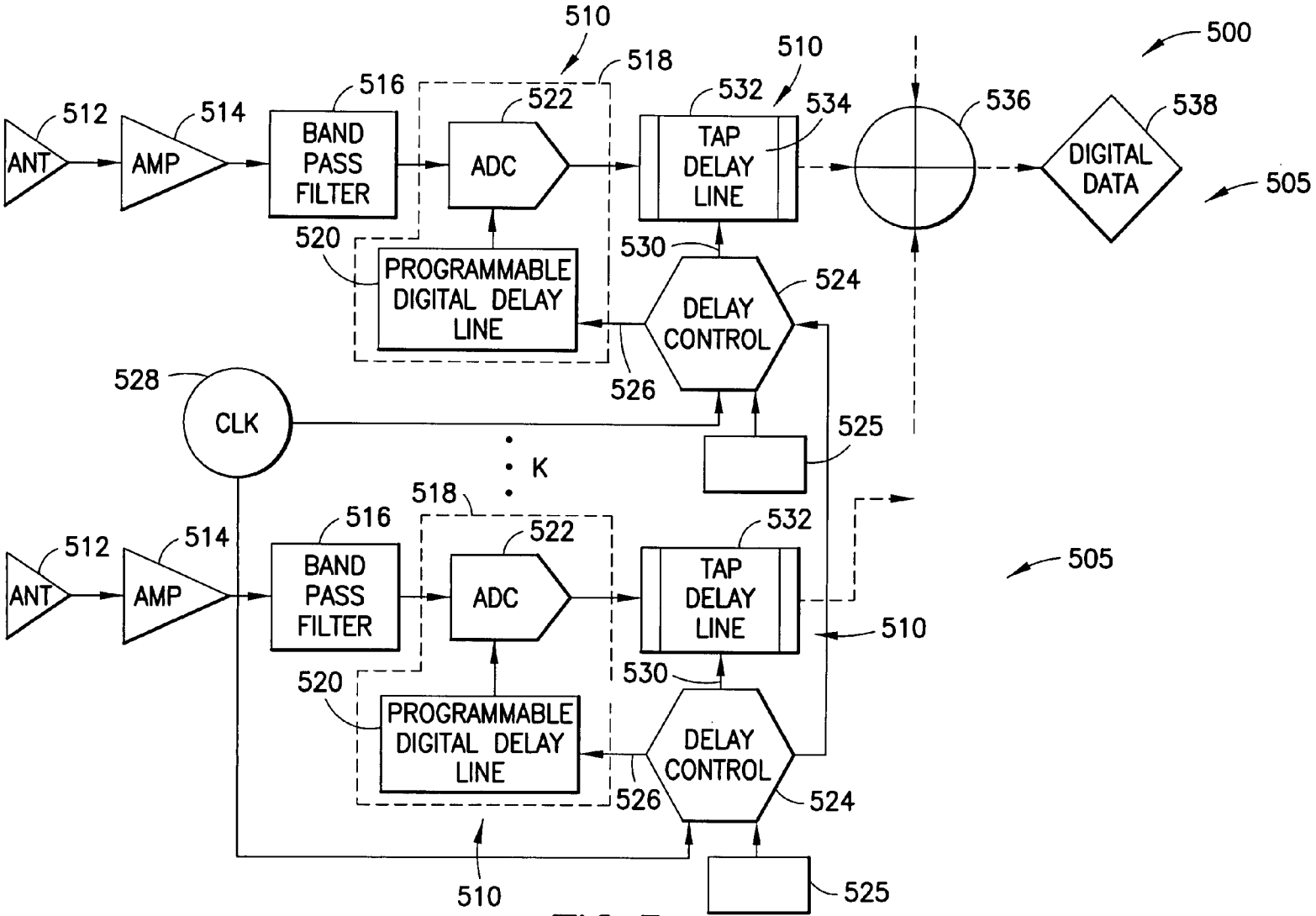
FIG. 5 depicts a beamforming network for use in combination with a multi-element antenna operating in a reception mode, the beamforming network made in accordance with the present invention.

FIG. 5 depicts a beamforming network 500 capable of operating in a receiving mode in combination with a multi-element antenna. A beamforming network operating in accordance with the present invention is generally operable to impart delays to a plurality of signals generated by individual elements of a multi-element antenna when the multi-element antenna is operated in a receiving mode. The various delays applied to the signals determine the directionality of the antenna when operating in a receiving mode. In particular by, for example, varying delays across antenna elements comprising the planar antenna energy may be collected from a particular direction.

The beamforming network 500 operates in combination with a multi-element antenna (not shown) having K antenna elements. Accordingly, there are K time delay circuits 505 to impart time delays to the K signals received from the K antenna elements. The beamforming network 500 comprises K antenna ports 512 for receiving signals from K antenna elements (not shown) comprising the multi-element antenna. The beamforming network 500 further comprises a delay control 524. The delay control 524 calculates a time delay to be applied to each of the plurality of K data signals in dependence on beamforming information provided by a memory 525. In the case of a multi-element antenna operating in a receiving mode, the beamforming information provided to the delay control 524 will be used to control the directionality of the multi-element antenna operating in combination with the beamforming network 500. The beamforming network 500 depicted in FIG. 5 is coupled to a two-dimensional planar antenna, and thus the beamforming control information comprises azimuth and elevation information. The time delay calculated for each of the K data signals comprises a fine delay control component expressed in terms of a fraction of a whole clock cycle of digital clock reference 528 and a coarse delay control component expressed in terms of a number of whole clock cycles of the digital clock reference 528. The delay control 524 further comprises fine delay control signal outputs 526 and coarse delay control signal outputs 530 for each of the K time delay circuits 505 comprising the beamforming network 500.

Each of the K time delay circuits 505 further comprises delay application means 510 comprised of a fine delay means 518 and a coarse delay means 532. In the embodiment depicted in FIG. 5, each of the K time delay circuits 505 is coupled to an antenna port 512 corresponding to a particular antenna element of the multi-element antenna. The K signals received by the K time delay circuits 505 from the antenna ports 512 are amplified by amplifiers 514 and then filtered by band-pass filters 516. After amplification and filtering, the signals are coupled to the fine delay means 518. The fine delay means 518 depicted in FIG. 5 comprises programmable digital delay lines 520 and analog-to-digital converters 522. The programmable digital delay lines 520 are coupled to the fine delay control signal outputs 526 of the delay control 524. The programmable digital delay lines 520 generate analog-to-digital clock delay signals for delaying the clocks of the analog-to-digital converters in dependence on the fine delay control signals generated for each of the K signals by the delay control 524. The delays of the analog-to-digital converter 522 clocks serve to impart fine delays to the signals. The particular fine delay imparted to individual ones of the K signals may differ from the fine delay imparted to individual others of the K signals. As in the case of the preceding embodiments the fine delay means 518 depicted in FIG. 5 is exemplary; in other embodiments within the scope of the present invention, the fine delay may be imparted within or outside the context of an analog-to-digital conversion.

After fine delays have been imparted to the K signals by the fine delay means 518 of each of the K time delay circuits 505, the signals are then coupled to coarse delay means 532. In the embodiment depicted in FIG. 5, the coarse delay means 532 of each of the K time delay circuits 505 comprises a tap delay line 534. The tap delay lines 534 are coupled to the coarse delay control signal outputs 530 of the delay control 524. The tap delay lines 534 impart a coarse delay corresponding to a number of whole clock cycles of the digital clock reference 528 to each of the K signals. The particular coarse delay imparted to individual ones of the K signals may differ from the coarse delay imparted to individual others of the K signals. After the K signals have been delayed by the coarse delay means 532 of each of the K time delay circuits 505, they are summed by summer 536 and the resulting digital data 538 is available for further processing.

As indicated previously, the time delays imparted by time delay circuits 505 comprising the beamforming network 500 determine the directionality of the multi-element antenna when the multi-element antenna is operating in a receiving mode. Additional control over the directionality of the multi-element antenna can be achieved by applying non-linear progressive delays to particular signals comprising the K signals. Further control over the effective shape of the beam envelope used to collect energy can be achieved by varying the gain applied by amplifiers 514 to individual signals, particularly to signals generated by antenna elements on edges of the multi-element antenna.

Figure 6:
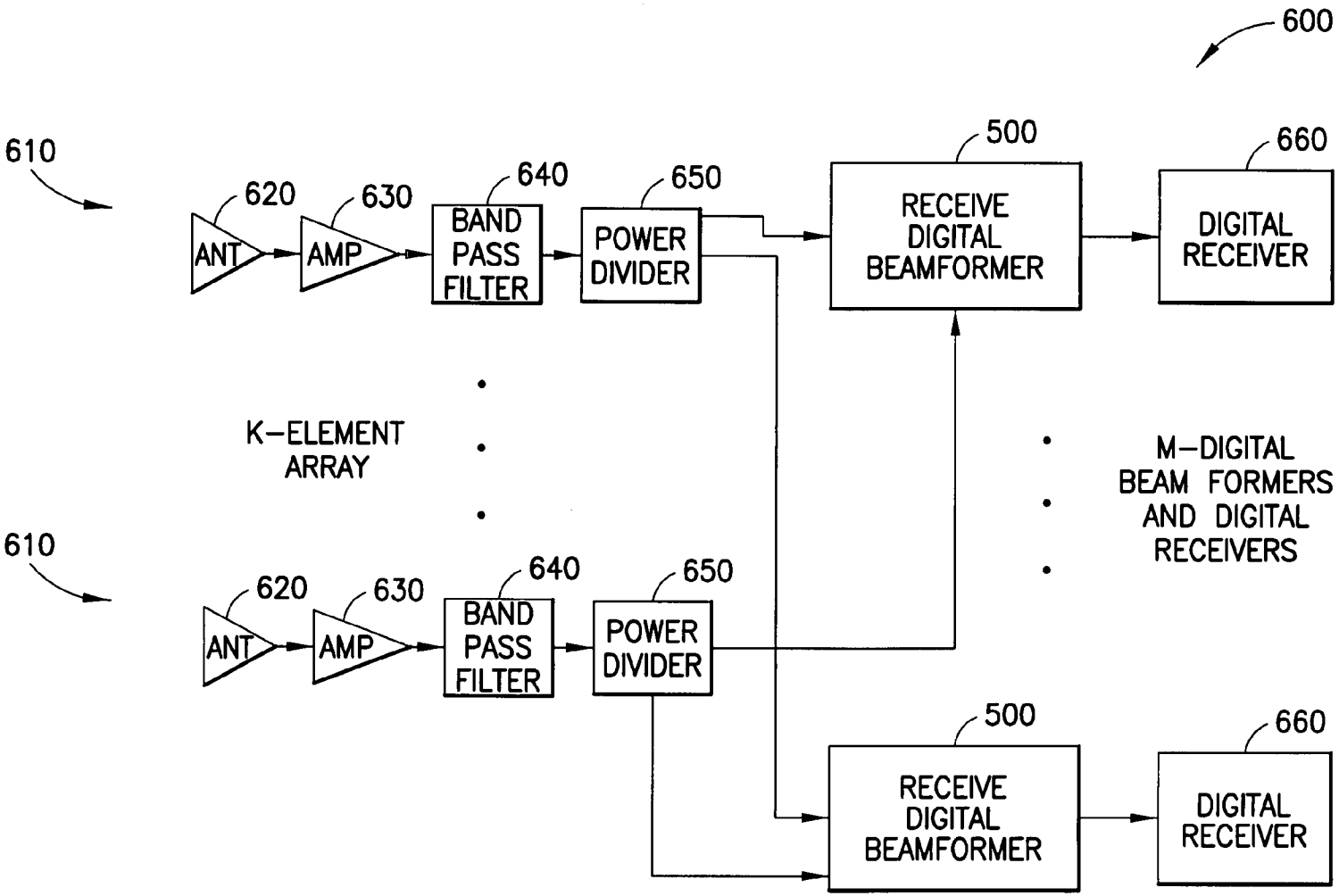
FIG. 6 depicts a beamforming system capable of generating multiple simultaneous beams in combination with a multi-element antenna operating in a reception mode, the beamforming system made in accordance with the present invention.

A beamforming system 600 for operating in a receiving mode is depicted in FIG. 6. The beamforming system 600 depicted in FIG. 6 is operable with M receiving beams. In the beamforming system 600, each antenna element of a multi-element antenna is coupled to an antenna port 620. There are K antenna ports 620 for K antenna elements of the multi-element antenna. The antenna ports are in turn coupled to amplifiers 630 and band-pass filters 640 After amplification and filtering, power dividers 650 divide each of K signals into M separate signals for processing as constituent elements of M separate receive beams by receive digital beamformers 500 like that depicted in FIG. 5. After the appropriate delays are applied to the K signals associated with each of the M beams, the K signals are coupled to digital receivers 660 for further processing in accordance with a particular application (such as, for example, radar; telecommunications or electronic warfare).

Methods of the present invention will now be described. One of ordinary skill in the art will understand that the methods of the present invention can be embodied in a physical memory medium as a computer program. The physical memory may be coupled to digital processing apparatus capable of executing the computer program and thus implementing the methods of the present invention in a beamforming network coupled to a multi-element antenna. In a method 700 depicted in FIG. 7, at step 705, a digital processor executing a computer program implementing the method receives a command to calculate a delay to be applied to a data signal associated with an antenna element coupled to a beamforming circuit, wherein the particular antenna element is part of a multi-element antenna. Then, at step 710, the digital processor accesses beamforming control information, wherein the beamforming control information determines physical characteristics of a beam to be formed by the multi-element antenna. Next, at step 715, the digital processor calculates a coarse delay in dependence on the beamforming control information, wherein the coarse delay corresponds to a number of whole clock cycles of a digital clock reference the signal is to be delayed. Then, at step 720, the digital processor generates a coarse delay control signal reflecting the coarse delay calculated for the signal. Next, at step 725, the coarse delay control signal is provided to coarse delay means operable to delay the signal by the coarse delay indicated in the coarse delay control signal. Then, at step 730, the coarse delay means delays the signal by the coarse delay. Next, at step 735, the digital processor calculates a fine delay in dependence on the beamforming control information. The fine delay corresponds to a portion of a whole clock cycle of the digital clock reference. Then, at step 740, the digital processor generates a fine delay control signal reflecting the fine delay calculated for the signal. Next, at step 745, the fine delay control signal is provided to fine delay means operable to delay the signal by the delay indicated in the fine delay control signal. Next, at step 750, the signal is delayed by the fine delay means in accordance with the fine delay indicated in the fine delay control signal.

One of ordinary skill in the art will understand that the foregoing method can be adapted for use in transmitting and receiving situations.

Figure 7:
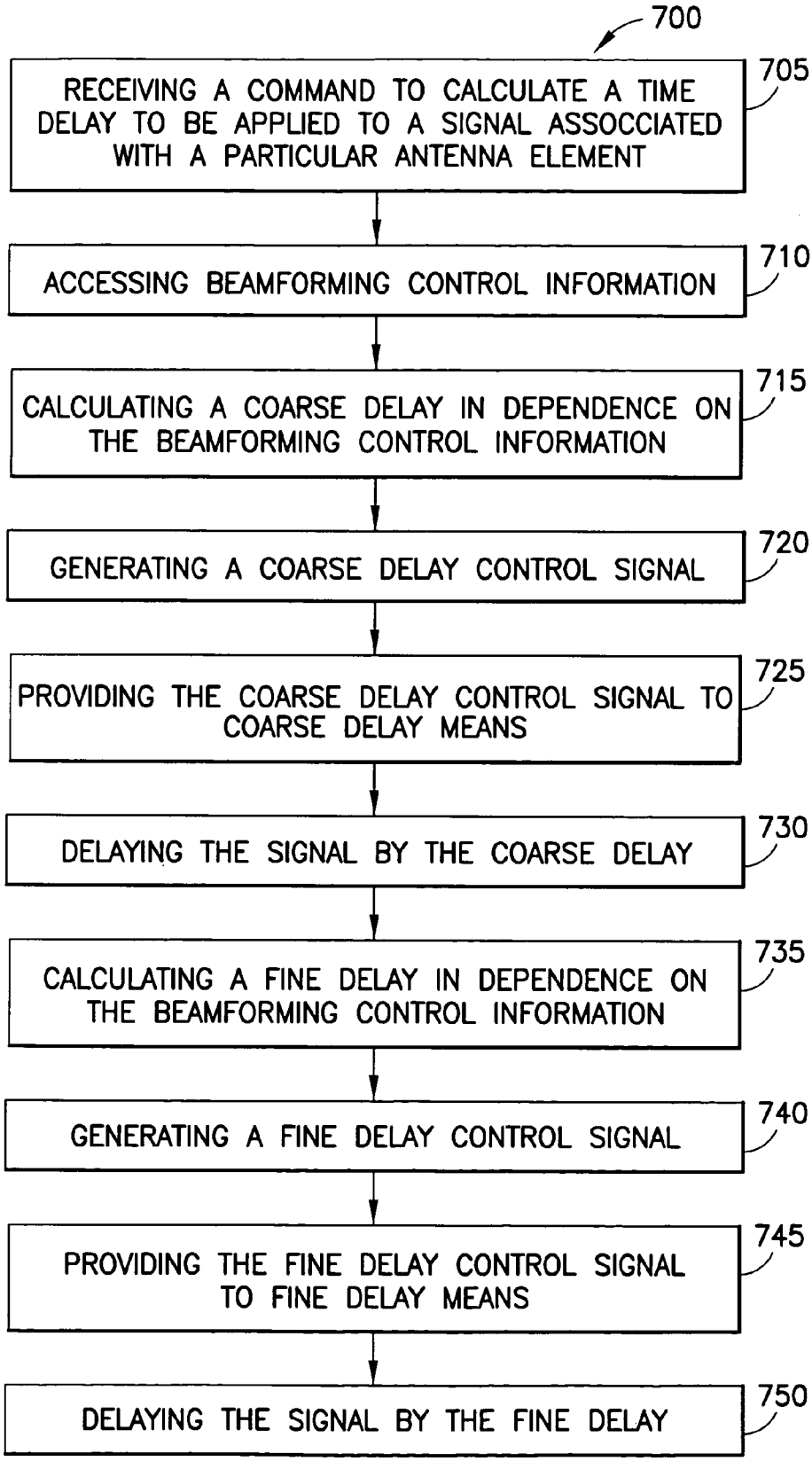
FIG. 7 is a flow diagram depicting a method operating in accordance with the present invention.

In variants of the method depicted in FIG. 7 the coarse delay means comprises a tap delay line, and the fine delay means comprises a programmable digital delay line.

Figure 8:
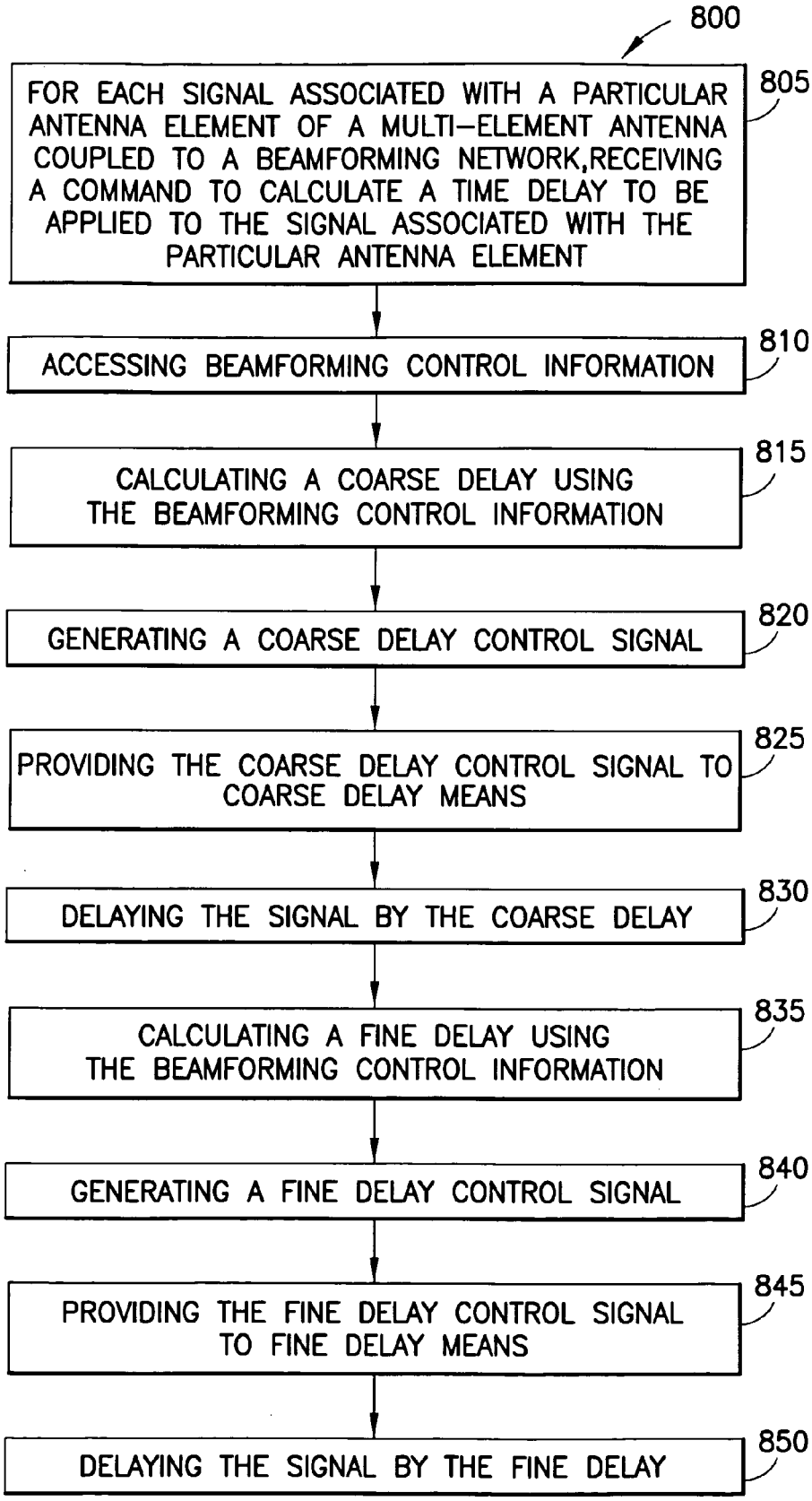
FIG. 8 is a flow diagram depicting a method operating in accordance with the present invention.

Another method 800 of the present invention is depicted in FIG. 8, and is operable in a beamforming network coupled to a multi-element antenna. At step 805, for each signal associated with a particular element of a multi-element antenna coupled to the beamforming network, a digital processor associated with the beamforming network receives a command to calculate a delay to be applied to the signal associated with the particular antenna element. Then, at step 810, the digital processor accesses beamforming control information, wherein the beamforming control information determines physical characteristics of a beam to be formed by the multi-element antenna. Next, at step 815, the digital processor calculates a coarse delay in dependence on the beamforming control information, wherein the coarse delay corresponds to a number of whole clock cycles of a digital clock reference the signal is to be delayed. Then, at step 820, the digital processor generates a coarse delay control signal reflecting the coarse delay calculated for the signal. Next, at step 825, the coarse delay control signal is provided to coarse delay means operable to delay the signal by the coarse delay indicated in the coarse delay control signal. Then, at step 830, the coarse delay means delays the signal by the coarse delay indicated in the coarse delay control signal. Next, at step 835, the digital processor calculates a fine delay in dependence on the beamforming control information, wherein the fine delay corresponds to a portion of a whole clock cycle of the digital clock reference. Then, at step 840, the digital processor generates a fine delay control signal indicating the fine delay calculated for the signal. Next, at step 845, the fine delay control signal is provided to fine delay means operable to delay the signal by the fine delay indicated in the fine delay control signal. Then, at step 850, the fine delay means delays the signal by the fine delay.

One of ordinary skill in the art will understand that the methods depicted and described herein in embodiments of the present invention are reflected in one or more computer programs that may be stored in a physical memory medium. Instructions comprising the one or more computer programs tangibly embodied in the computer-readable memory medium perform the steps of the methods when executed by one or more digital processors incorporated in a beamforming network. Tangible computer-readable memory media include, but are not limited to hard drives, CD- or DVD-ROM, flash memory storage devices or in a RAM or ROM memory of a computer system or fixed logic circuits.

Thus it is seen that the foregoing description has provided by way of exemplary and non-limiting examples a full and informative description of the best method and apparatus presently contemplated by the inventors for implementing a wideband digital beamforming network. One skilled in the art will appreciate that the various embodiments described herein can be practiced individually; in combination with one or more other embodiments described herein; or in combination with beamforming methods and networks differing from those described herein. Further, one skilled in the art will appreciate that the present invention can be practiced by other than the described embodiments; that these described embodiments are presented for the purposes of illustration and not of limitation; and that the present invention is therefore limited only by the claims which follow.

We claim:

1. A time delay circuit for imparting a time delay to a data signal associated with an antenna element in a multi-element antenna, the time delay circuit comprising:

a data signal input for accepting the data signal to be delayed by the time delay circuit;

a digital clock reference;

a memory storing beamforming control information, wherein the beamforming control information determines physical characteristics of a beam to be formed by the multi-element antenna;

a delay control coupled to the memory, where the delay control calculates the time delay to be applied to the data signal in dependence on the beamforming control information, wherein the time delay calculated by the delay control comprises a coarse delay control component expressed in terms of a number of whole clock cycles of the digital clock reference and a fine delay control component expressed in terms of a portion of a whole clock cycle of the digital clock reference, the delay control further comprising a coarse delay control signal output for conveying a coarse delay control signal corresponding to the coarse delay control component and a fine delay control signal output for conveying a fine delay control signal corresponding to the fine delay control component;

a tap delay line coupled to the data signal input and the coarse delay control signal output of the delay control, the tap delay line for imparting a coarse delay to the data signal by delaying the data signal in dependence on the coarse delay control signal, the tap delay line having an output for conveying the data signal after the data signal has been delayed by the coarse delay;

a programmable digital delay line coupled to the fine delay control signal output of the delay control and to the digital clock reference, the programmable digital delay line generating a digital-to-analog converter clock delay signal in dependence on the fine delay control signal, the programmable digital delay line having an output; and a digital-to-analog converter coupled to the output of the tap delay line and the output of the programmable digital delay line for performing a digital-to-analog conversion on the data signal, wherein during the digital-to-analog conversion the data signal is further delayed by a fine delay corresponding to a portion of a whole clock cycle of the digital clock reference in dependence on the digital-to-analog clock converter delay signal, the digital-to-analog converter having an output for conveying the data signal to which has been imparted the coarse delay and the fine delay.

2. The time delay circuit of claim 1 further comprising:

a filter coupled to the output of the digital-to-analog converter for filtering the data signal, the filter having an output.

3. The time delay circuit of claim 2 wherein the filter is a band-pass filter.

4. The time delay circuit of claim 2 further comprising:

an amplifier coupled to the output of the filter for amplifying the data signal.

5. The time delay circuit of claim 1 wherein the data signal corresponds to a signal to be emitted by the antenna element when the data signal, after having been delayed by the coarse and fine delay, is applied to the antenna element.

6. The time delay circuit of claim 1 wherein the beamforming control information determines a shape of the beam.

7. The timed delay circuit of claim 1 wherein the beamforming control information determines a direction of the beam.

8. A time delay circuit for imparting a time delay to a signal associated with an antenna element in a multi-element antenna, the time-delay circuit comprising:

a signal input for accepting the signal to be delayed by the time delay circuit;

digital clock reference means for providing a digital clock reference signal;

memory means for storing beamforming control information, wherein the beamforming control information determines physical characteristics of a beam formed by the multi-element antenna;

delay control means coupled to the memory means for calculating the time delay to be applied to the signal in dependence on the beamforming control information, wherein the time delay calculated by the delay control means comprises a coarse delay control component expressed in terms of a number of whole clock cycles of the digital clock reference means and a fine delay control component expressed in terms of a portion of a whole clock cycle of the digital clock reference means, the delay control means further comprising:

coarse delay signal output means for conveying a coarse delay control signal corresponding to the coarse delay control component; and fine delay signal output means for conveying a fine delay control signal corresponding to the fine delay control component; and delay application means coupled to the signal input for applying the time delay calculated by the delay control means to the signal, the delay application means further comprising:

coarse delay means coupled to the coarse delay signal output means of the delay control means for imparting a coarse delay to the signal in dependence on the coarse delay control signal; and fine delay means coupled to the fine delay signal output means of the delay control means for imparting a fine delay to the signal in dependence on the fine delay control signal.

9. The time delay circuit of claim 8 where the multi-element antenna operates in a transmitting mode, and wherein the signal delayed by the coarse delay and fine delay will be emitted by the antenna element when the signal is applied to the antenna element.

10. The time delay circuit of claim 8 wherein the signal received by the time delay circuit at the signal input is generated by the antenna element when the multi-element antenna is operating in a receiving mode.

11. The time delay circuit of claim 8 where the coarse delay means comprises a tap delay line.

12. The time delay circuit of claim 8 wherein the fine delay means comprises, at least in part, a programmable digital delay line.

13. The time delay circuit of claim 12 wherein the fine delay means further comprises at least one of a digital-to-analog converter and an analog-to-digital converter.

14. The time delay circuit of claim 8 wherein the beamforming control information determines a shape of the beam.

15. The time delay circuit of claim 8 wherein the beamforming control information determines a direction of the beam.

16. A beamforming network for imparting time delays to a plurality of signals, where each signal is associated with a particular antenna element of a multi-element antenna, wherein the beamforming network further comprises:

a digital clock reference;

a memory storing beamforming control information, wherein the beamforming control information determines physical characteristics of a beam formed by the combination of the beamforming network and the multi-element antenna;

a delay control coupled to the memory, where the delay control calculates the time delay to be applied to each of the plurality of signals in dependence on the beamforming control information, wherein the time delay calculated for each of the signals comprises a coarse delay control component expressed in terms of a number of whole clock cycles of the digital clock reference and a fine delay control component expressed in terms of a portion of a whole clock cycle of the digital clock reference, the delay control having a coarse delay control signal output for conveying coarse delay control signals corresponding to the coarse delay control components calculated for each of the signals and a fine delay control signal output for conveying fine delay control signals corresponding to the fine delay control components calculated for each of the signals;

a plurality of time delay circuits, wherein each of the time delay circuits is associated with a particular signal and is coupled to a particular antenna element associated with the particular signal, each of the plurality of time delay circuits comprising:

an input port for receiving a particular signal; and delay application means coupled to the input port for imparting the time delay calculated for the particular signal by the delay control, the delay application means further comprising:

coarse delay means coupled to the coarse delay control signal output of the delay control, the coarse delay means imparting a coarse delay to the particular signal in dependence on the coarse delay control signal generated by the delay control for the particular signal, and fine delay means coupled to the fine delay control signal output of the delay control, the fine delay means imparting a fine delay to the particular signal in dependence on the fine delay control signal generated by the delay control for the particular signal.

17. The beamforming network of claim 16, wherein the beamforming network and multi-element antenna operate in a transmitting mode.

18. The beamforming network of claim 16, wherein the beamforming network and multi-element antenna operate in a receiving mode.

19. The beamforming network of claim 16, wherein the beamforming control information determines a shape of the beam.

20. The beamforming network of claim 16, wherein the beamforming control information determines a direction of the beam.

21. A beamforming system capable of generating a plurality of separate beams in combination with a multi-element antenna, the beamforming system comprising:

a plurality of beamforming networks, where each of the beamforming networks is associated with a particular beam of the plurality of separate beams to be formed by the beamforming system and the multi-element antenna, and where each of the beamforming networks is operable to impart time delays to a plurality of signals, where each signal is associated with a particular antenna element of the multi-element antenna, and where each of the beamforming networks further comprises:

a digital clock reference;

a memory storing beamforming control information, wherein the beamforming control information determines physical characteristics of a particular beam of the plurality of separate beams to be formed by the beamforming network and the multi-element antenna;

a delay control coupled to the memory, where the delay control calculates the time delay to be applied to each of the plurality of signals in dependence on the beamforming control information, wherein the time delay calculated for each of the signals comprises a coarse delay component expressed in terms of a number of whole clock cycles of the digital clock reference and a fine delay control component expressed in terms of a portion of a whole clock cycle of the digital clock reference, the delay control having a coarse delay control signal output for conveying coarse delay control signals corresponding to the coarse delay control components calculated for each of the signals and a fine delay control signal output for conveying fine delay control signals corresponding to the fine delay control components calculated for each of the signals;

a plurality of time delay circuits, wherein each of the time delay circuits is associated with a particular signal and is coupled to a particular antenna element associated with the particular signal, each of the plurality of time delay circuits comprising:

an input port for receiving a particular signal; and delay application means coupled to the input port for imparting the time delay calculated for the particular signal by the delay control, the delay application means further comprising:

coarse delay means coupled to the coarse delay control signal output of the delay control, the coarse delay means imparting a coarse delay to the particular signal in dependence on the coarse delay control signal generated by the delay control for the particular signal; and fine delay means coupled to the fine delay control signal output of the delay control, the fine delay means imparting a fine delay to the particular signal in dependence on the fine delay control signal generated by the delay control for the particular signal.

22. The beamforming system of claim 21 wherein the beamforming system and multi-element antenna operate in a transmitting mode.

23. The beamforming system of claim 21 wherein the beamforming system and multi-element antenna operate in a receiving mode.

24. The beamforming system of claim 21 wherein the beamforming system is operable to form multiple simultaneous beams in combination with the multi-element antenna.

25. The beamforming system of claim 21 wherein the coarse delay means of each of the time delay circuits comprises a tap delay line.

26. The beamforming system of claim 21 wherein the fine delay means of each of the time delay circuits comprises, at least in part, a programmable digital delay line.

27. The beamforming system of claim 26 wherein the fine delay means further comprises at least one of a digital-to-analog converter and an analog-to-digital converter.

28. The beamforming system of claim 21 wherein the beamforming control information associated with a particular beam determines a shape of the beam.

29. The beamforming system of claim 21 wherein the beamforming control information associated with a particular beam determines a direction of the beam.

30. A memory medium storing a computer program executable by a digital processor incorporated in a beamforming circuit, whereby when the digital processor executes the computer program operations are performed, the operations comprising:

receiving a command to calculate a time delay to be applied to a signal associated with a particular antenna element coupled to the beamforming circuit, wherein the particular antenna element is part of a multi-element antenna;

accessing beamforming control information, wherein the beamforming control information determines physical characteristics of a beam to be formed by the multi-element antenna;

calculating a coarse delay in dependence on the beamforming control information, wherein the coarse delay corresponds to a number of whole clock cycles of a digital clock reference the signal is to be delayed;

generating a coarse delay control signal reflecting the coarse delay calculated for the signal;

providing the coarse delay control signal to coarse delay means operable to delay the signal by the coarse delay indicated in the coarse delay control signal;

delaying the signal associated with the particular antenna element by the coarse delay indicated in the coarse delay control signal;

calculating a fine delay in dependence on the beamforming control information, wherein the fine delay corresponds to a portion of a whole clock cycle of the digital clock reference;

generating a fine delay control signal reflecting the fine delay calculated for the signal;

providing the fine delay control signal to fine delay means operable to delay the signal by the fine delay indicated in the fine delay control signal;

delaying the signal associated with the particular antenna element by the fine delay indicated in the fine delay control signal; and whereby the combination of the delay operations performed by the coarse delay means and the fine delay means in dependence on the coarse delay control signal and the fine delay control signal delay the signal associated with the particular antenna element by the sum of the number of whole clock cycles of the digital clock reference indicated in the coarse delay control signal and the portion of a whole clock cycle of the digital clock reference indicated in the fine delay control signal.

31. The memory medium of claim 30 wherein the operations are performed when the multi-element antenna is operating in a transmitting mode.

32. The memory medium of claim 30 wherein the operations are performed when the multi-element antenna is operating in a receiving mode.

33. The memory medium of claim 30, wherein the beamforming control information determines a direction of the beam formed by the multi-element antenna.

34. The memory medium of claim 30, wherein the beamforming control information determines a shape of the beam formed by the multi-element antenna.

35. The memory medium of claim 30, wherein the coarse delay means comprises a tap delay line.

36. The memory medium of claim 30, wherein the fine delay means comprises a programmable digital delay line.

37. A memory medium storing a computer program executable by at least one digital processor incorporated in a beamforming network, whereby when the at least one digital processor executes the computer program operations are performed, the operations comprising:

for each signal associated with a particular antenna element of a multi-element antenna coupled to the beamforming network, receiving a command to calculate a time delay to be applied to the signal associated with the particular antenna element;

accessing beamforming control information, wherein the beamforming control information determines physical characteristics of a beam to be formed by the multi-element antenna;

calculating a coarse delay in dependence on the beamforming control information, wherein the coarse delay corresponds to a number of whole clock cycles of a digital clock reference the signal is to be delayed;

generating a coarse delay control signal reflecting the coarse delay calculated for the signal;

providing the coarse delay control signal to coarse delay means operable to delay the signal by the coarse delay indicated in the coarse delay control signal;

delaying the signal associated with the particular antenna element by the coarse delay indicated in the coarse delay control signal;

calculating a fine delay in dependence on the beamforming control information, wherein the fine delay corresponds to a portion of a whole clock cycle of the digital clock reference;

generating a fine delay control signal reflecting the fine delay calculated for the signal;

providing the fine delay control signal to fine delay means operable to delay the signal by the fine delay indicated in the fine delay control signal;

delaying the signal associated with the particular antenna element by the fine delay indicated in the fine delay control signal; and whereby the combination of the delay operations performed by the coarse delay means and the fine delay means in dependence on the coarse delay control signal and the fine delay control signal delay the signal associated with the particular antenna element by the sum of the number of whole clock cycles of the digital clock reference indicated in the coarse delay control signal and the portion of a whole clock cycle of the digital clock reference indicated in the fine delay control signal.

38. The memory medium of claim 37 where the multi-element antenna comprises at least one linear array of antenna elements, wherein beamwidth control of the beam formed by the multi-element antenna is achieved by applying non-linear progressive delays to the signals associated with particular antenna elements.

39. The memory medium of claim 37 wherein the multi-element antenna comprises at least one linear array of antenna elements, wherein beamwidth control of the beam formed by the multi-element antenna is further achieved by selectively controlling gains applied to signals coupled to antenna elements at ends of the linear array.

40. The memory medium of claim 37 wherein the operations are performed when the multi-element antenna is operating in the transmitting mode.

41. The memory medium of claim 37 wherein the operations are performed when the multi-element antenna is operating in the receiving mode.

42. The memory medium of claim 37, wherein the beamforming control information determines the direction of the beam.

43. The memory medium of claim 37, wherein the beamforming control information determines the shape of the beam.

* * * * *